US008201879B2

(12) United States Patent
Hartenstine et al.

(10) Patent No.: US 8,201,879 B2
(45) Date of Patent: Jun. 19, 2012

(54) TRAY SYSTEM FOR CHILD'S HIGH CHAIR

(75) Inventors: Curtis M. Hartenstine, Birdsboro, PA (US); Adam D. Bearup, Lakewood, CO (US)

(73) Assignee: Wonderland Nurserygoods Co., Ltd, Taipei (TW)

( * ) Notice: Subject to any disclaimer, the term of this patent is extended or adjusted under 35 U.S.C. 154(b) by 427 days.

(21) Appl. No.: 12/367,514

(22) Filed: Feb. 7, 2009

(65) Prior Publication Data

US 2009/0206638 A1 Aug. 20, 2009

Related U.S. Application Data

(60) Provisional application No. 61/066,309, filed on Feb. 19, 2008.

(51) Int. Cl.
*A47B 83/02* (2006.01)

(52) U.S. Cl. ..... 297/153; 297/149

(58) Field of Classification Search ..... 297/148, 297/149, 153

See application file for complete search history.

(56) References Cited

U.S. PATENT DOCUMENTS

| | | | | |
|---|---|---|---|---|
| 4,807,928 | A * | 2/1989 | Cone | 297/153 |
| 5,810,432 | A | 9/1998 | Haut | 297/153 |
| 6,293,623 | B1 * | 9/2001 | Kain et al. | 297/423.25 X |
| 6,416,124 | B1 * | 7/2002 | Chen et al. | 297/149 X |
| 6,419,312 | B1 * | 7/2002 | Flannery et al. | 297/149 X |
| 6,481,790 | B2 | 11/2002 | Cheng | |
| 6,497,452 | B2 | 12/2002 | Catelli | 297/153 |
| 7,419,210 | B2 * | 9/2008 | Nolan et al. | 297/153 |

FOREIGN PATENT DOCUMENTS

| | | |
|---|---|---|
| CN | 2164231 | 5/1994 |
| CN | 2484828 | 4/2002 |

* cited by examiner

*Primary Examiner* — Anthony D Barfield
(74) *Attorney, Agent, or Firm* — Miller Law Group, PLLC

(57) ABSTRACT

A high chair is equipped with a tray system incorporating a multiple tray structure that is positionally adjustable relative to the high chair structure. The tray system includes a smaller lower tray formed with rearwardly extending, horizontal posts that are received within horizontally aligned sockets in the high chair structure. The distal ends of the tray posts are provided with rollers, and the high chair sockets have rollers, to provide for a smooth insertion of the posts into the sockets. The larger upper tray is detachably mounted on the lower tray for positional adjustment with the lower tray by releasing the tray posts for movement within the high chair sockets. The larger tray is formed with a depression to allow access to the position adjustment actuator. A third tray can be supported on the larger tray to facilitate cleaning of the tray system.

17 Claims, 10 Drawing Sheets

TRAY SYSTEM FOR CHILD'S HIGH CHAIR

CROSS-REFERENCE TO RELATED APPLICATIONS

This application claims priority on U.S. Provisional Patent Application Ser. No. 61/066,309, filed on Feb. 19, 2008, the content of which is incorporated herein by reference.

FIELD OF THE INVENTION

The present invention relates generally to a child's high chair and, more particularly, to a tray system, including a multiple tray structure and having support posts formed with rollers to facilitate mounting on the high chair.

BACKGROUND OF THE INVENTION

Different products are used by parents to aid in the positioning of their children to facilitate feeding them from the time the child is an infant until the child is old enough and large enough to sit at a table properly. One such product is a high chair, which is typically used to support infants and small toddlers at an elevated position so that the caregiver can easily feed the child. The high chair is a self-standing unit that provides a safe and secure seating area with a feeding tray that is removable from the high chair to facilitate the placement of the child on the high chair and to facilitate the cleaning of the tray and high chair structure. High chairs can incorporate height adjustment mechanism so that the seat can be vertically positioned to fit various table heights so that the tray mechanism could be removed from the high chair and the child positioned on the high chair be pushed up to a table.

High chairs can provide different tray options. Some high chair configurations provide a smaller snack tray under the typical large high chair tray. These snack trays are attached to the high chair seat and do not have the ability to be adjusted in and out to accommodate different child sizes. Furthermore, since the snack tray is directly attached to the high chair seat, the care giver is required to lift the child up and over the snack tray in order to seat the child in the high chair, or to remove the child from the high chair. Although some snack trays can be removed from the high chair seat without tools, the removal of the snack tray typically requires two hands and the snack tray is usually only removed when the high chair is being used without the large tray, such as when the child in the high chair is pushed directly up to the table. While the snack tray is not typically adjustable positionally, the large tray is usually positionally adjustable on the snack tray.

Only a few high chairs commercially available utilize a post to socket tray connection, in which the tray is formed with rearwardly projecting horizontal posts that are received within sockets formed in the high chair structure. The post and socket design can be advantageous over other tray mounting designs in that the tray is easy to align when fastening to the high chair seat and the tray offers a strong interlocking connection with the high chair structure to withstand extreme cases of abuse during product use. Even so, the post and socket design is not without drawbacks. The post and socket tray mounting design typically suffers from high amounts of friction between post and socket and from the need to actuate the tray adjustment mechanism before for connecting the tray to the high chair seat.

The friction problem is typically resolved in a limited manner by using dissimilar materials for the tray post and high chair socket components. While dissimilar materials do alleviate the friction problem, the post and socket mounting trays remain difficult to adjust positionally relative to the high chair as the tray posts often bind or stick. The caregiver can become frustrated and loose motivation for removing the tray altogether. As a result, the value of having a removable tray can be unrealized or underappreciated by the caregiver.

A high chair with a double tray apparatus is disclosed in U.S. Pat. No. 5,810,432, issued to Robert Haut, et al on Sep. 22, 1998. The high chair has a lower snack tray mounted on the high chair structure with a larger upper tray mounted on the lower tray through a latch mechanism that engages the sides of the lower tray. The upper tray is positionally adjustable on the lower tray without requiring the movement of the lower tray. In U.S. Pat. No. 6,497,452, granted on Dec. 24, 2002, to Pietro Catelli, a double tray arrangement for a child's high chair is disclosed. The top cover of the tray is removably mounted thereon. A hooking member is provided to latch the upper tray to the lower base tray. The hooking member includes a slider cooperatively associated with an operating slide button forming the actuator of the high chair tray adjustment feature.

It would be desirable to provide a high chair tray system incorporating a multiple tray structure that will provide allow an easy positioning of the tray on the high chair and provide improved flexibility in the use of the tray.

SUMMARY OF THE INVENTION

It is an object of this invention to provide a high chair with a multiple tray structure that includes support posts on which are mounted rollers to facilitate engagement of the tray structure on the high chair.

It is another object of this invention to provide a high chair tray with roller supports that facilitate a one-handed positioning of the tray onto the high chair.

It is a feature of this invention that the tray posts incorporate a roller at the distal end thereof.

It is another feature of this invention that the high chair is formed with passageways for receipt of the tray posts, the passageways incorporating a roller to support the tray posts within the high chair passageways.

It is still another feature of this invention that the rollers mounted on the end of the tray posts and the rollers mounted within the passageways facilitate the sliding of the tray posts within the high chair structure.

It is an advantage of this invention that the tray structure can be manipulated with a single hand to allow an easy mounting of the tray onto the high chair.

It is yet another feature of this invention that the tray system has an actuation mechanism that is incorporated into the lower snack tray on which the tray posts are formed.

It is another advantage of this invention that the multiple tray structure utilizes a common actuation mechanism for controlling the position of the tray system relative to the high chair structure.

It is still another advantage of this invention that the actuation control is accessible when the larger upper tray is mounted on the smaller lower tray.

It is still another object of this invention to provide a double tray configuration for a child's high chair that allows for positional adjustment of both the upper tray and the lower snack tray.

It is still another feature of this invention that the larger upper tray is latched onto the smaller lower tray having the tray posts formed therewith.

It is yet another feature of this invention that the larger upper tray incorporates a depression in the structure of the tray so that the position adjustment button can be accessed while the larger upper tray is mounted on the lower tray.

It is still another advantage of this invention that the lower tray can be positionally adjusted with the larger tray to accommodate children of different sizes.

It is yet another advantage of this invention that the lower tray can be removed from the high chair to facilitate the positioning of the child into or out of the high chair without requiring the child to be lifted over the lower tray.

It is a further advantage of this invention that the tray and socket design for a high chair tray can be utilized without suffering from friction problems between the tray post and the high chair socket.

It is still a further advantage of this invention that the positional adjustment of the tray system can be accomplished easily without sticking and binding between the tray post and the high chair socket.

It is a further feature of this invention that the tray system can be mounted onto the high chair structure without requiring actuation of the position adjustment mechanism.

It is yet another object of this invention to provide a tray system for a child's high chair that is durable in construction, inexpensive of manufacture, carefree of maintenance, facile in assemblage, and simple and effective in use.

These and other objects, features and advantages are accomplished according to the instant invention by providing a high chair equipped with a tray system incorporating a multiple tray structure that is positionally adjustable relative to the high chair structure. The tray system includes a smaller lower tray formed with rearwardly extending, horizontal posts that are received within horizontally aligned sockets in the high chair structure. The distal ends of the tray posts are provided with rollers, and the high chair sockets have rollers, to provide for a smooth insertion of the posts into the sockets. The larger upper tray is detachably mounted on the lower tray for positional adjustment with the lower tray by releasing the tray posts for movement within the high chair sockets. The larger tray is formed with a depression to allow access to the position adjustment actuator. A third tray can be supported on the larger tray to facilitate cleaning of the tray system.

BRIEF DESCRIPTION OF THE DRAWINGS

The advantages of this invention will be apparent upon consideration of the following detailed disclosure of the invention, especially when taken in conjunction with the accompanying drawings wherein.

DETAILED DESCRIPTION OF THE PREFERRED EMBODIMENT

Figure 1:
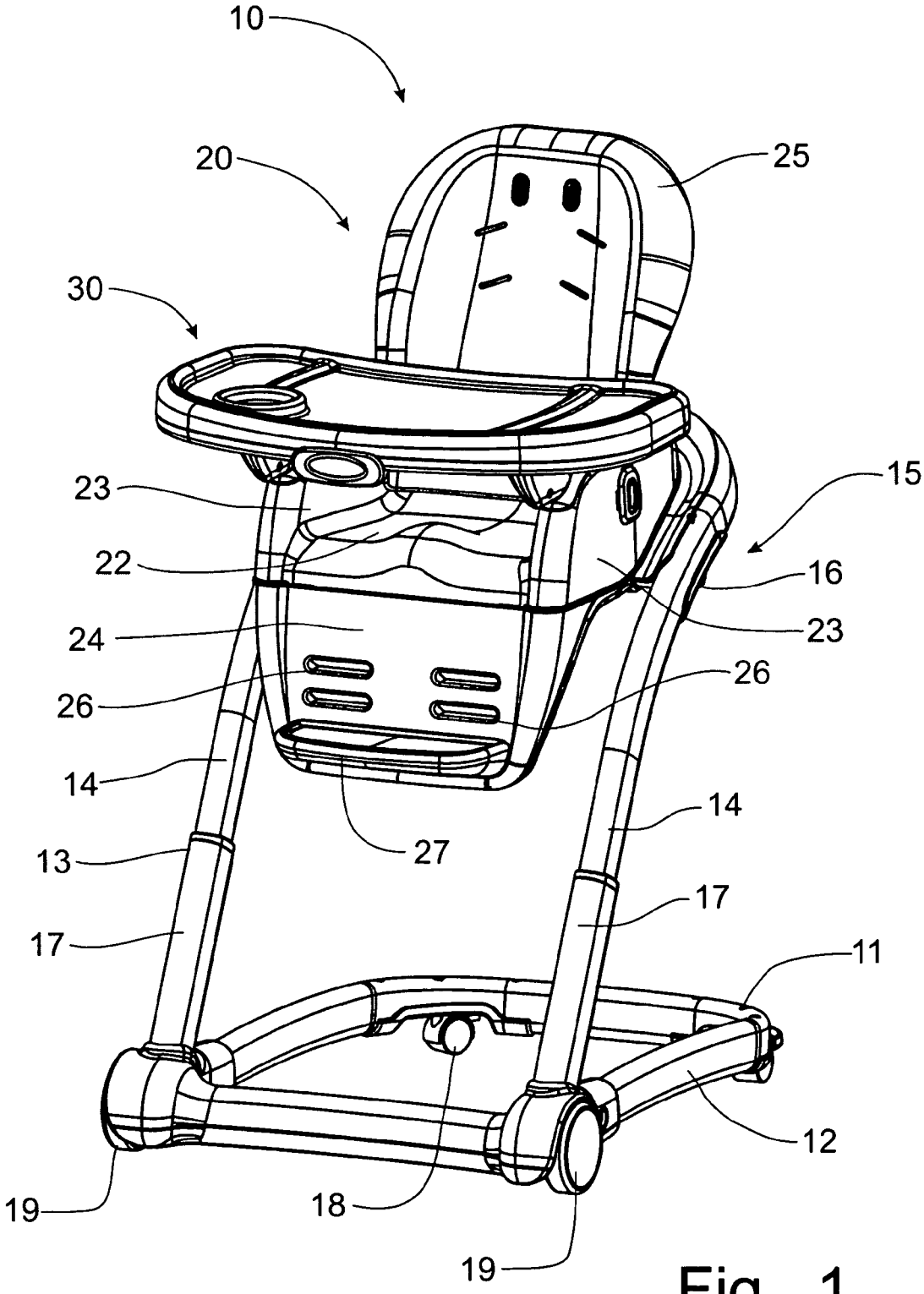
FIG. 1 is a front perspective view of a high chair incorporating the principles of the instant invention.

Referring now to the drawings, a high chair incorporating the principles of the instant invention can best be seen. In terms of general structure, the high chair 10 can include a Z-shaped frame 11 that has a base portion 12 and a generally vertically extending upright portion 13 that meets the base portion 12 at an acute angle. The upright portion 13 includes a pair of laterally spaced base legs 17 that receive respective telescopic legs 14 that can be optionally spring-biased to an extended position to offset the weight of the seat member 20 and a child that can be seated in the seat member 20. The position of the telescopic legs 14 relative to the base legs 17 is controlled by a height adjustment latch mechanism 15 having an actuator 16 supported on each of the telescopic legs 14. The base portion 12 is preferably equipped with a set of fixed wheels 19 at the joint between the base portion 12 and the base legs 17 of the upright portion 13, and a pair of caster wheels 18 to provide mobility to the Z-frame 11.

The Z-frame 11 supports a seat member 20 at an upper portion thereof. The seat member 20 is formed with a generally horizontal seat portion 22, which is surrounded on the two lateral sides by upright side walls 23 that form arm rests and in the back between the arm rests 23 by a seat back 25. The front of the seat member 20 is open to accommodate the legs of a child seated on the seat portion 22, but is formed with a foot rest support 24 that extends downwardly from the forward edge of the seat portion 22. The foot rest support 24 is preferably formed with a plurality of vertically spaced pairs of horizontally oriented mounting slots 26 into which a foot rest 27 can be inserted for selective positioning according to the size of the child being supported on the seat member 20. The seat member 20 is supported on the Z-frame 11, but positioned such that the side wall 23, particularly along the back portion 25 of the seat member 20, is spaced from the Z-frame 11, which preferably curves from one telescopic leg 14 to the other.

Figure 5:
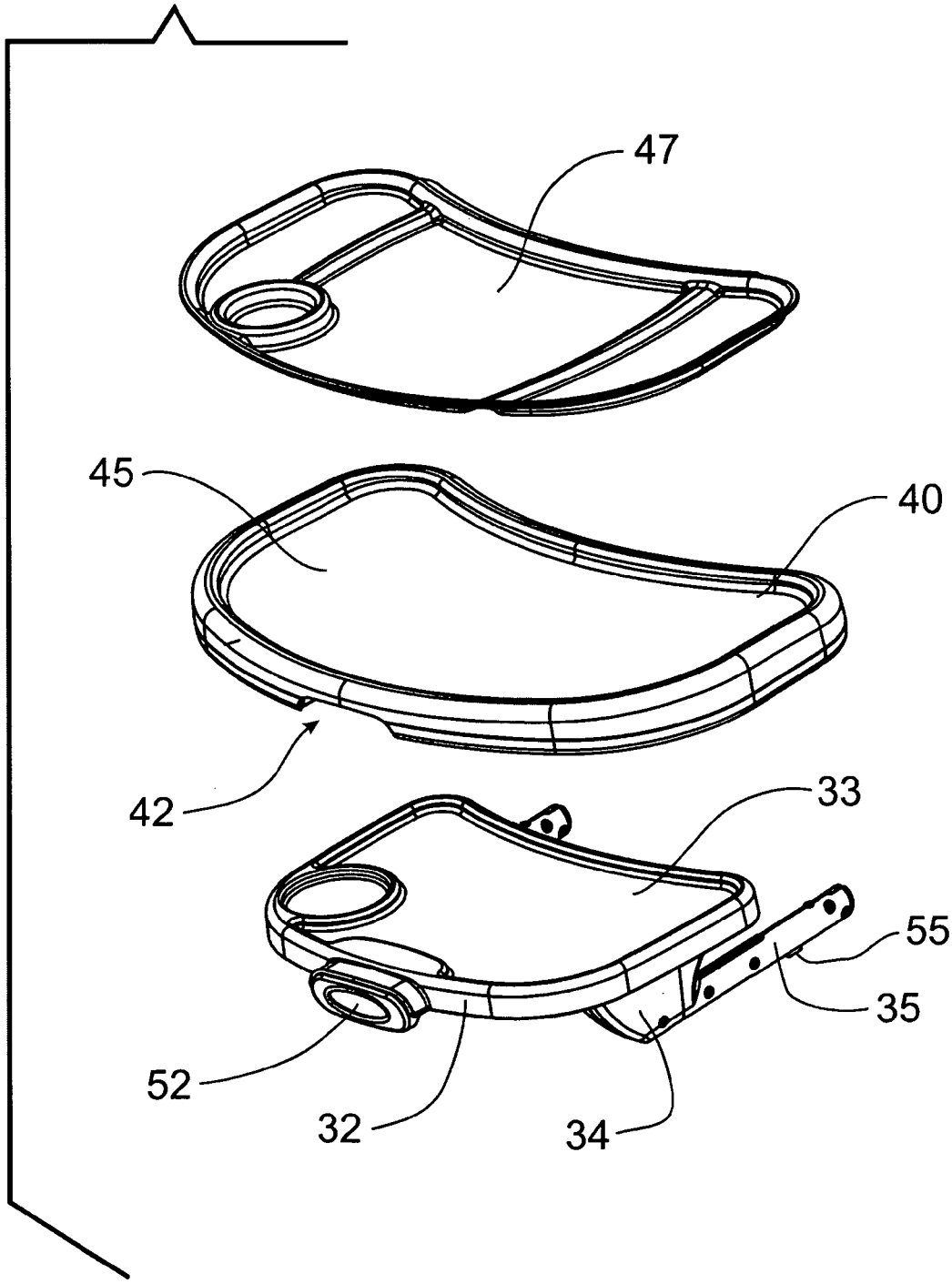
FIG. 5 is an exploded upper perspective view of the tray configuration including the lower tray, upper tray and the tray insert.
Figure 6:
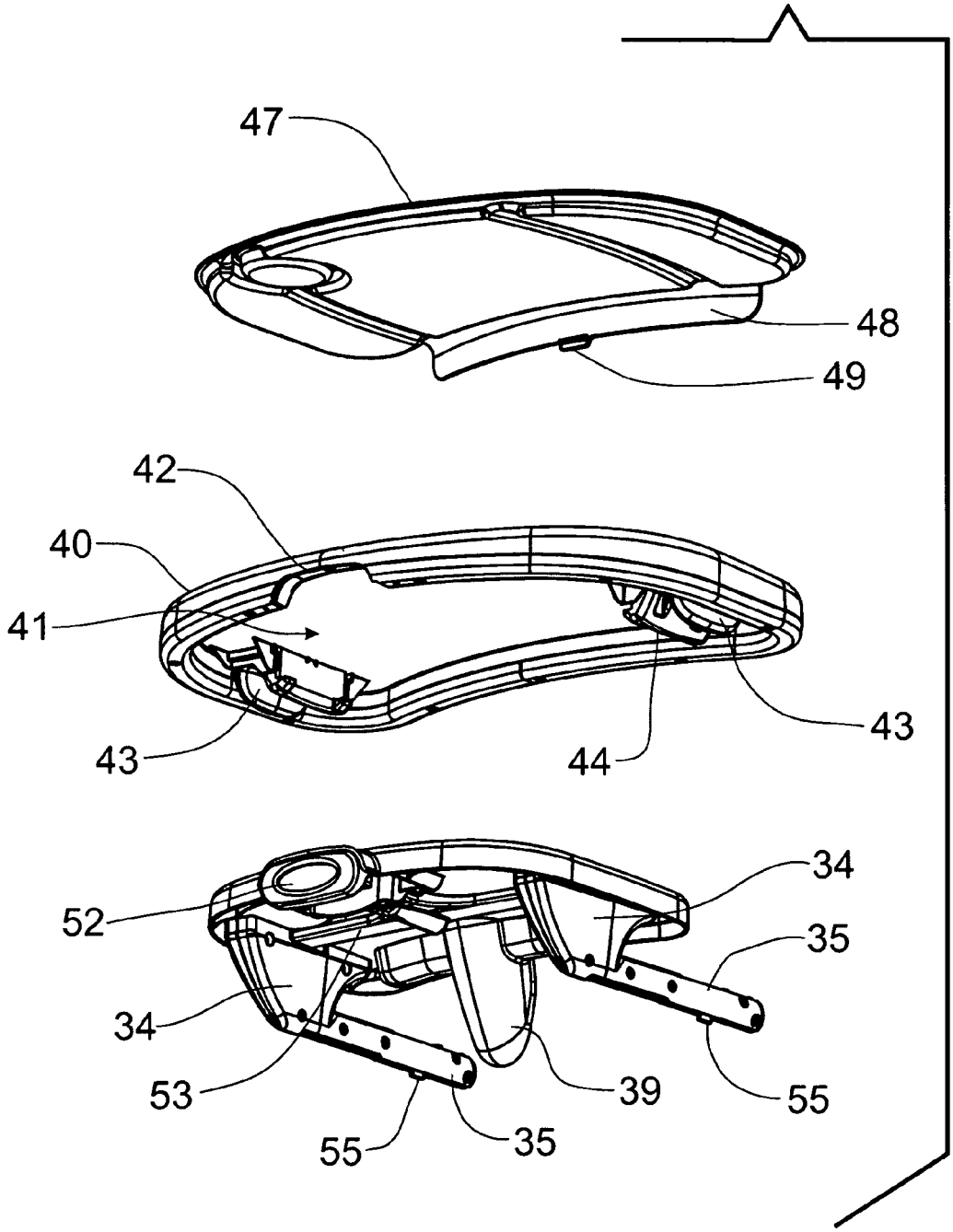
FIG. 6 is an exploded lower perspective view of the tray configuration shown in FIG. 5.
Figure 7:
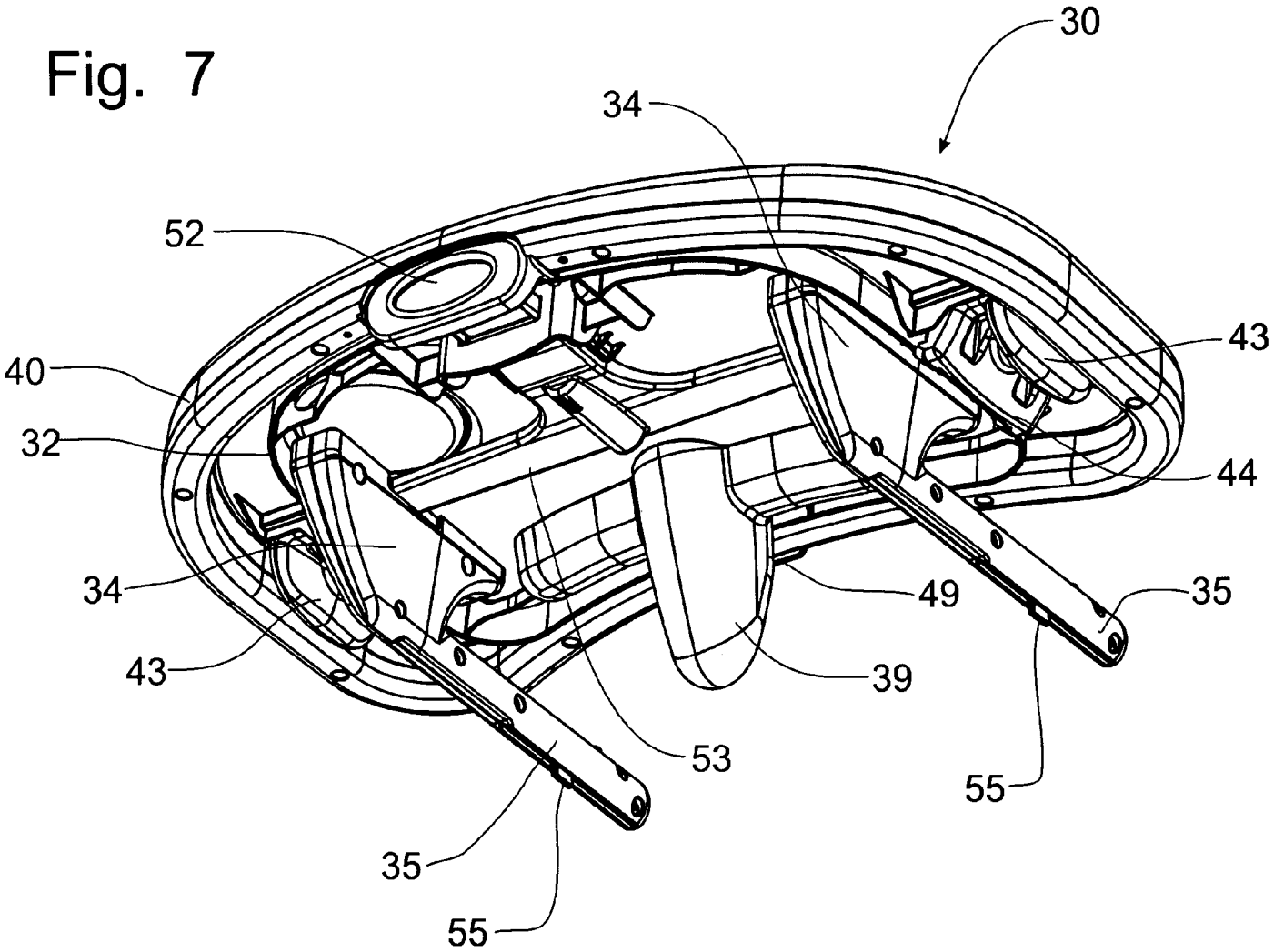
FIG. 7 is a lower perspective view of the tray assembly.
Figure 8:
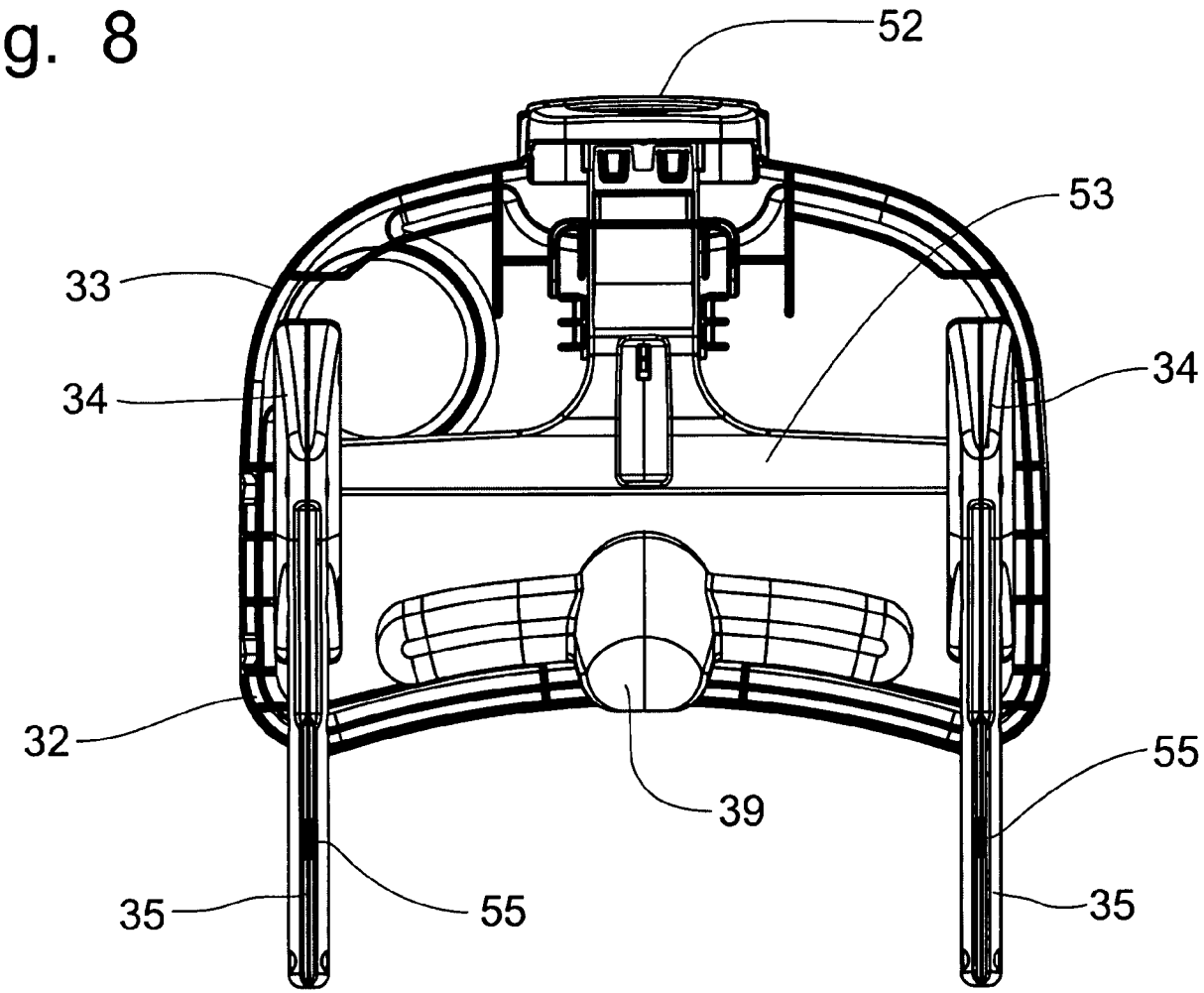
FIG. 8 is a bottom plan view of the lower tray with the upper tray removed therefrom.
Figure 9:
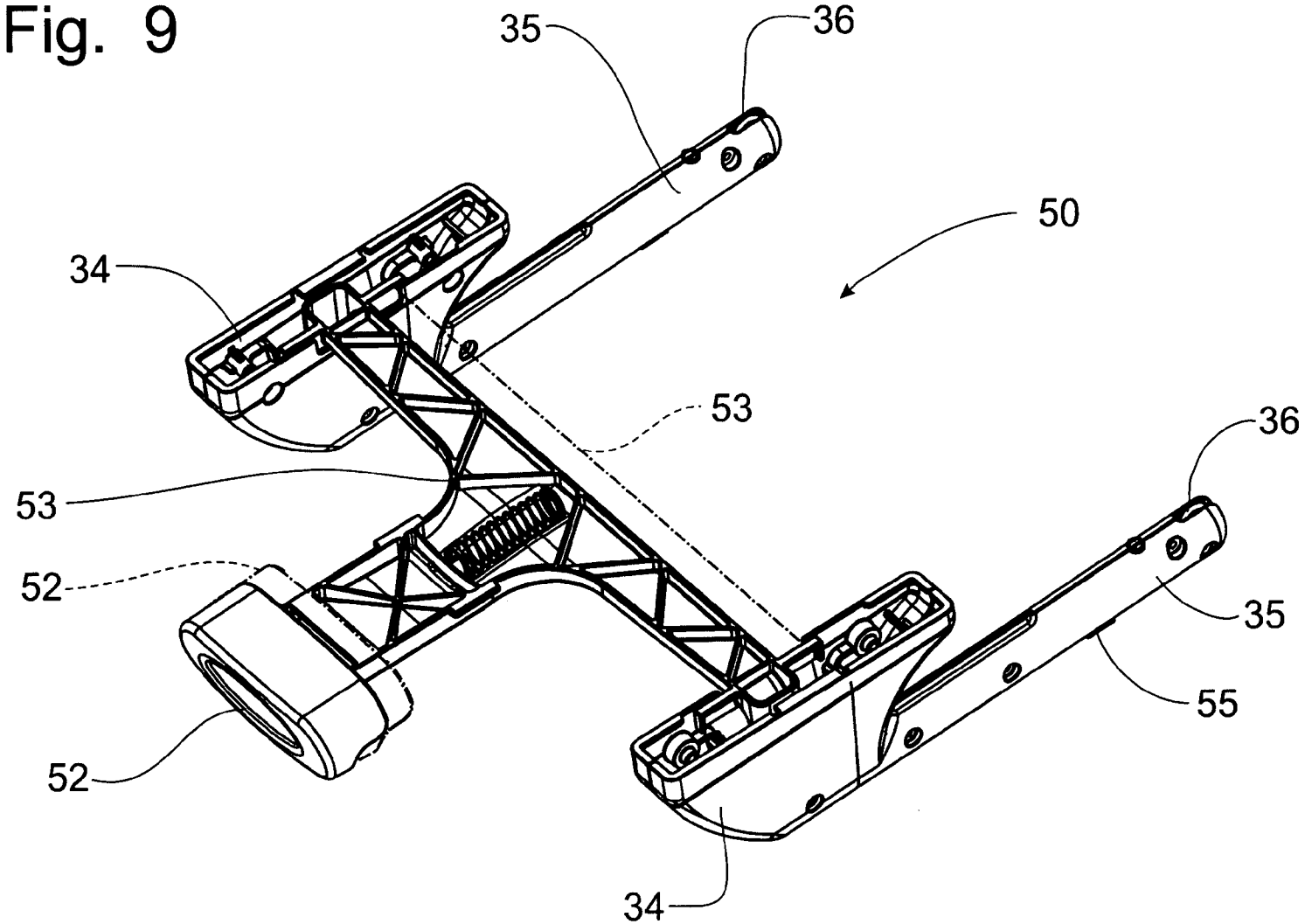
FIG. 9 is an upper perspective view of the position adjustment actuation mechanism, the movement of the slide link being shown in phantom.
Figure 10:
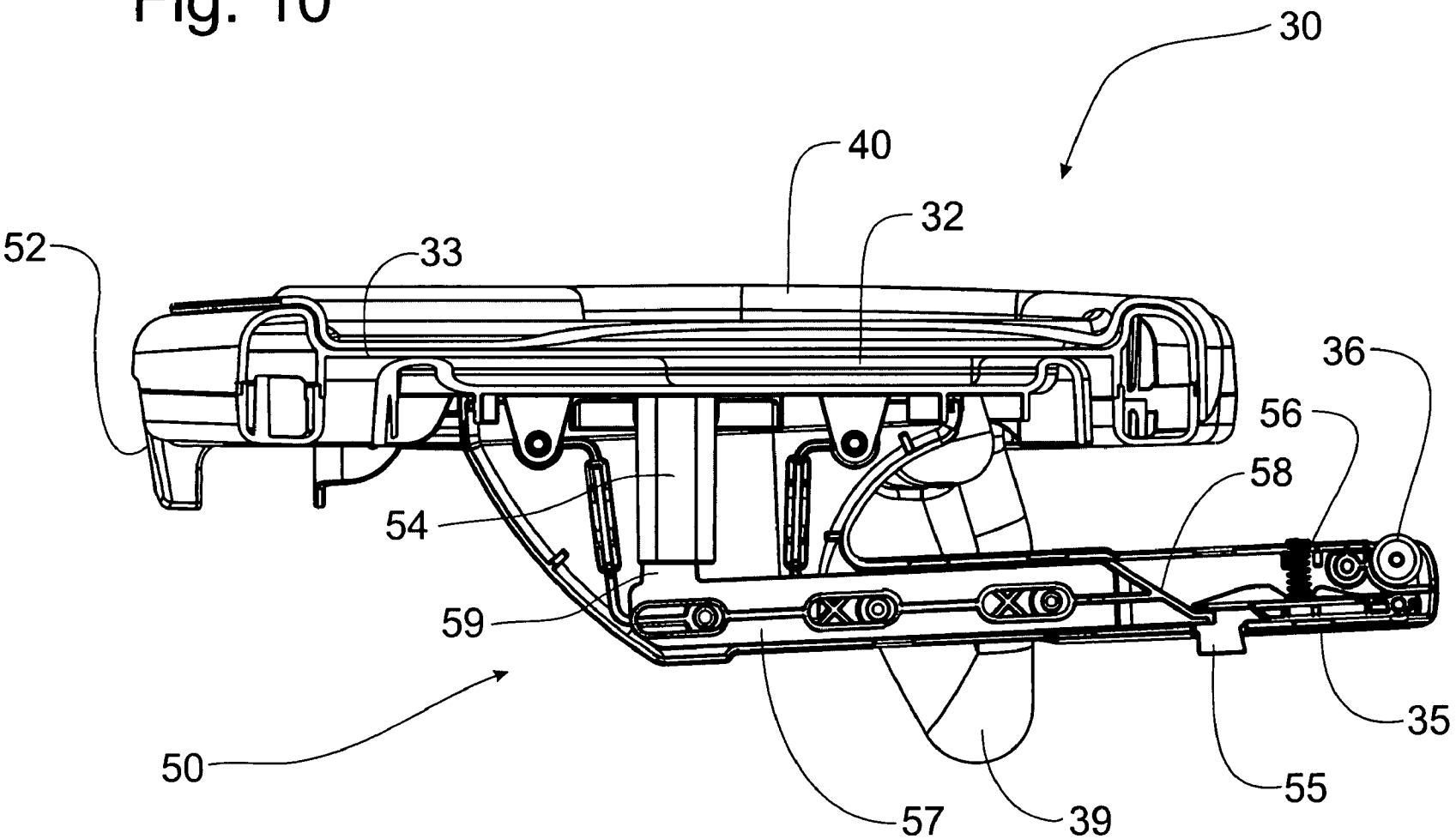
FIG. 10 is a side elevational view of the tray system with portions thereof broken away to better view the position adjustment actuation mechanism extending through the tray posts.

The tray system 30 is generally formed of a small lower tray 32 that is mounted on the high chair structure 10, as will be described in greater detail below, a larger upper tray 40 and a tray insert 47, which can be seen best in the exploded views of FIGS. 5 and 6. The lower tray 32, which can also be referred to as a travel tray as this smaller tray configuration takes up less space when traveling than the larger regular tray 40, is sized to fit within a depression 41 formed into the underside of the larger upper tray 40. The underside of the upper tray 40 is provided with a pair of laterally spaced latch members 43 that are positioned to engage the sides of the lower tray 32 to allow the upper tray 40 to be mounted on top of the lower tray 32. The latch members 43 are preferably slidable along the underside of the upper tray 40 so as to be movable between an outward release position and an inward engagement position.

The latch members 43 project below the underside of the upper tray 40 so as to be engagable with the sides of the lower tray 32 and so that the top surface of the lower tray 32 will nest the larger upper tray 40. With the nesting arrangement between the upper and lower trays 40, 32, the upper tray 40 is only positioned a short distance above the lower tray 32 substantially equal to the thickness of the material forming the upper tray 40. Since the upper tray 40 does not incorporate a position adjustment mechanism that enables the upper tray 40 to be moved relative to the lower tray 32, the overall vertical height of the tray system 30 is minimized and is easier to manipulate with one hand.

Preferably, the latch members 43 are spring-biased into the inward engagement position such that the caregiver would need to grasp the latch members 43 on each side that pull the latch members 43 outwardly to affect a release of the sides of the lower tray 32 to enable the upper tray 40 to be removed from the lower tray 32. Conversely, the shape of the latch members 43 should be beveled along the interior side 44 thereof so that the upper tray 40 can be installed onto the lower tray 32 simply by positioning the upper tray 40 over the lower tray 32 and pressing downwardly thereon. The beveled edges 44 of the latch members 43 will cam the latch members 43 outwardly to allow the engagement thereof with the sides of the lower tray 32, with the spring bias closing the latch members 43 into the engagement position.

The upper surface 45 of the upper tray 40 is depressed so as to provide a rimmed surface 45 that will retain food and other items. A tray insert 47 can be placed onto the upper surface 45, as is reflected in the exploded views of FIGS. 5 and 6, to provide a readily removable surface that can facilitate the cleaning of the upper tray 40. The tray insert 47 can be formed with a downwardly extending rear ledge 48 that incorporated a small retainer lip 49 at the center thereof. The tray insert 47 is sized to fit into the depressed upper surface 45 of the upper tray 40 with the rearward ledge extending downwardly along the lower surface of the upper tray 40 so that the retainer lip 49 can snap under the upper tray 40 and detachably secure the tray insert 47 on the upper tray 40. As shown in FIGS. 5 and 6, the tray insert can be shaped to be compartmentalized, including a circular compartment for a cup.

The lower tray 32 is formed with laterally spaced, rearwardly extending, generally horizontal tray posts 35 that are shaped to fit into corresponding sockets 28 formed into the upper portions of the respective arm rests 23. Each of the tray posts 35 have a roller 36 mounted at the distal end thereof and located along the upper surface so that the roller 36 will engage the top surface of the socket 28 as the tray post 35 moves within the socket 28. Furthermore, each of the sockets 28 includes a roller 29 built into the structure of the arm rest 23 on the lower surface near the front of the socket 28, as can be seen best in FIG. 2. This roller 29 supports the underside of the tray post 35 as the tray post 35 moves along the socket 28. With the combination of the roller 36 on the end of the tray post 35 and the roller 29 at the front of the socket 28, the tray post 35 can move within the socket 28 effortlessly without concern over frictional forces.

From a structural standpoint, the lower tray 32 is formed as a relatively flat tray member 33 with lateral legs 34 on opposing sides of the tray 32 to elevate the tray member 33 above the tray posts 35 that extend rearwardly from the legs 34. The central part of the tray 32 is formed with a retention horn member 39 that projects downwardly from the tray 32 to restrict the movement of a child placed on the seat 20 when the tray system 30 is mounted on the high chair 10. The horn member 39 is positionally adjustable with the tray member 33 relative to the seat portion 22. Furthermore, when the lower tray 32 is removed from the high chair 10, all obstructions to placing a child onto the seat portion 22, such as the tray system 30 itself and the retention horn member 39, are removed from the high chair 10 to facilitate the positioning of the child on the seat portion.

The rollers 29, 36 are preferred embodiments of the invention as the rollers 29, 36 present a rolling surface that essentially eliminates the friction problem between the tray post 35 and the socket 28; however, the rollers 29, 36 can be replaced with other anti-friction member embodiments. As an example, one or both of the respective rollers 29, 36 could be replaced by an anti-friction post (not shown) formed of a wear resistant, low friction coefficient material, such as nylon or Teflon, that could slide in anti-friction grooves (not shown) formed in the top of the socket 28 and the bottom of the tray post 35 to provide contact points between the tray post 35 and the socket 28 with minimal friction therebetween so as to facilitate positioning and adjustment of the tray assembly 30.

In addition, one skilled in the art will recognize that the roller 36 is placed at the top of the distal end of the tray post 35 and the roller 29 is located at the lower surface at the front of the socket 28 because of the weight of the tray members 32, 40, 47 is exerted through the legs 34 to the forward end of the tray posts 35, which form a cantilevered arrangement when the tray posts 35 are mounted in the sockets 28. Thus, the tray posts 35 are normally inclined within the sockets 28 so that the distal end of the tray posts 35 are pressed into the top surface of the sockets 28, and the tray posts 35 bear on the lower, front surface of the sockets 28. However, with this arrangement, an upward force exerted on the front of the tray assembly 30 can cause some movement of the tray posts 35 within the sockets 28. Accordingly, a optional third roller (not shown) could be placed into the lower surface of the sockets 28 at a selected location spaced rearwardly of the front roller 29 to provide additional support for the tray posts 35 when received within the sockets 28.

Operationally, the mounting of the larger upper tray 40 on the smaller lower tray 32, when the lower tray 32 is adjustably mounted on the high chair 10, allows the entire tray system 30 to be positionally adjusted relative to the seat portion 22 to accommodate differently sized children. The position actuation system 50, which will be described in greater detail below, allows the tray system 30 to be mounted onto the high chair 10 by simply aligning the tray posts 35 with the sockets 28 and inserting the tray posts 35 into the sockets 28 with a rearwardly directed force without manipulation of the position adjustment mechanism 50. Accordingly, the tray system 30 can be placed onto the high chair 10 by the caregiver with a single hand, which is a significant advantage to a caregiver that is holding a child. Furthermore, the lower tray 32 can be positionally adjusted, rather than just the larger upper tray.

The position actuation mechanism 50 is housed in the lower tray 32 and includes an actuation button 52 that is located at the front of the lower tray 32 for convenient access thereto. Preferably, the actuation button 52 projects outwardly from the lower tray 32 a sufficient distance to accommodate the positioning of the larger upper tray 40 on top of the lower tray 32 such that the face of the actuation button 52 is substantially aligned with the forward edge of the upper tray 40. To accept this positioning of the upper tray 40, the upper tray 40 is formed with a corresponding notch 42 in the front edge thereof to receive the actuation button 52.

The lower surface of the socket 28 is formed with a series of longitudinally spaced openings therein to receive the tip of a latch member 55 that is pivotally mounted within each tray post 35 at the distal end thereof with the tip projecting out of the tray post into engagement with the openings in the socket 28, one opening corresponding to each adjusted position of the tray system 30. Preferably, the pivoted latch member 55 is biased into engagement with the openings in the socket 28 by a spring 56 so that the tray system 30 will be retained in the selected position until a positive action is undertaken to release the latch member 55 from engagement with the opening in the socket 28.

That positive action to force the release of the latch member 55 from engagement with the openings in the lower surface of the socket 28 is provided by an actuation arm 57 that is mounted within each tray post 35 for sliding movement in a fore-and-aft direction. The actuation arm 57 is formed with a cammed end 58 that is positioned to engage the latch member 55 and force upward pivotal movement thereof against the biasing force exerted by the spring 56 when the actuation arm slides rearwardly. The forward portion of the actuation arm 57 is formed with an upwardly extending engagement member 59.

The actuation button 52 is the forwardly extending portion of a slide link 53 that is mounted for longitudinal sliding movement underneath the lower tray 32, as can be seen best in FIGS. 6-9. The slide link 53 is T-shaped and has laterally extending arms that terminate in engagement cups 54 that capture the engagement members 59 of the respective actuation arms 57 within the tray posts 35. Accordingly, the action of depressing the actuation button 52 causes the slide link 53 to move rearwardly underneath the lower tray 32 and, thus, affect a rearward movement of the engagement cups 54. Since the engagement members 59 are received within the engagement cups 54, the actuation arms 57 also slide rearwardly within the tray posts 35 to force the cammed ends 58 of the actuation arms 57 into engagement with the latch members 55 to cause a pivotal movement of the latch members 55 upwardly against the biasing springs 56 and disengage the tips of the latch members 55 from the selected opening in the socket 28.

Figure 2:
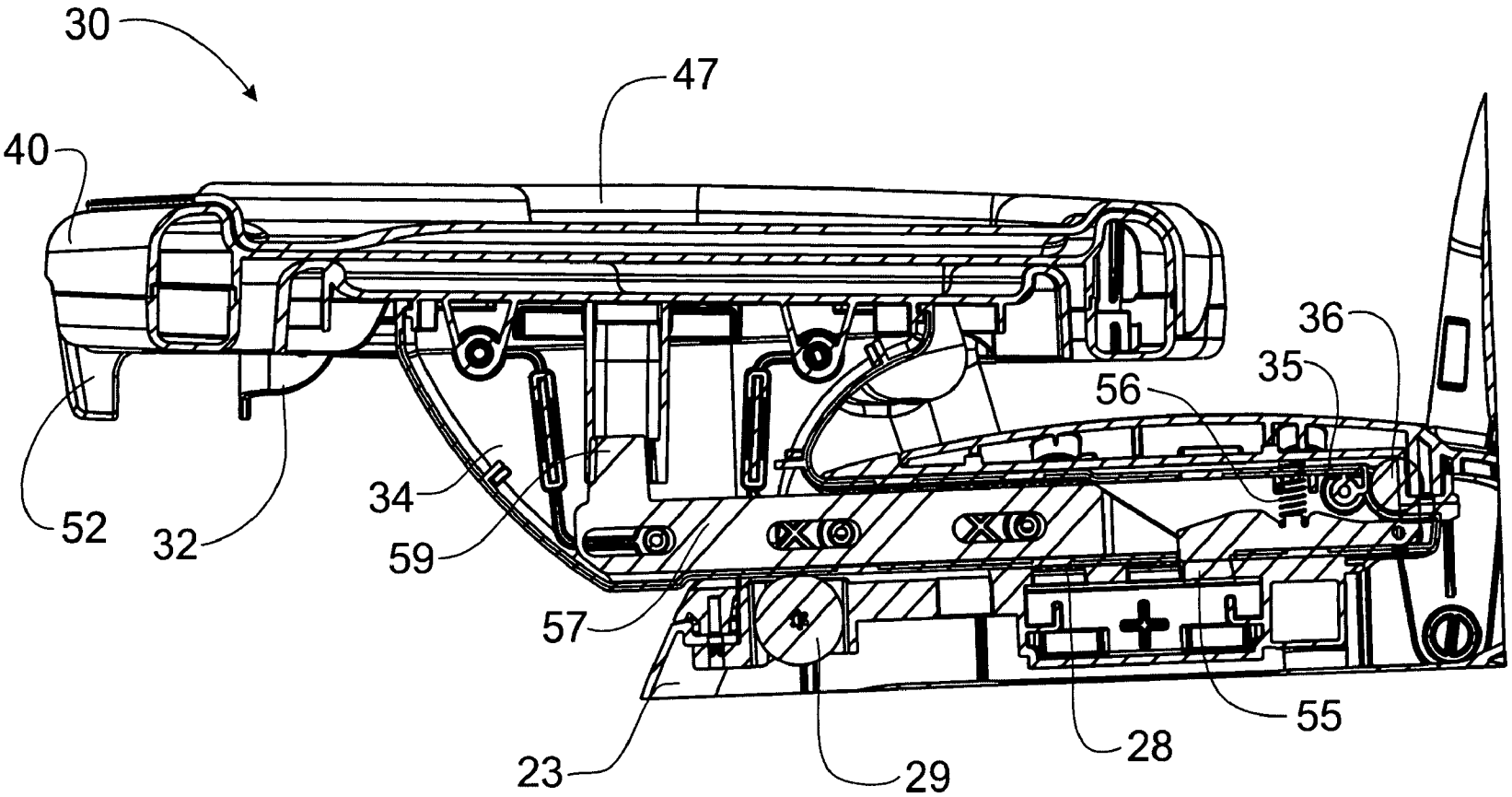
FIG. 2 is a cross-sectional view through the tray post and high chair socket to depict the mounting of the tray system on the high chair structure.
Figure 3:
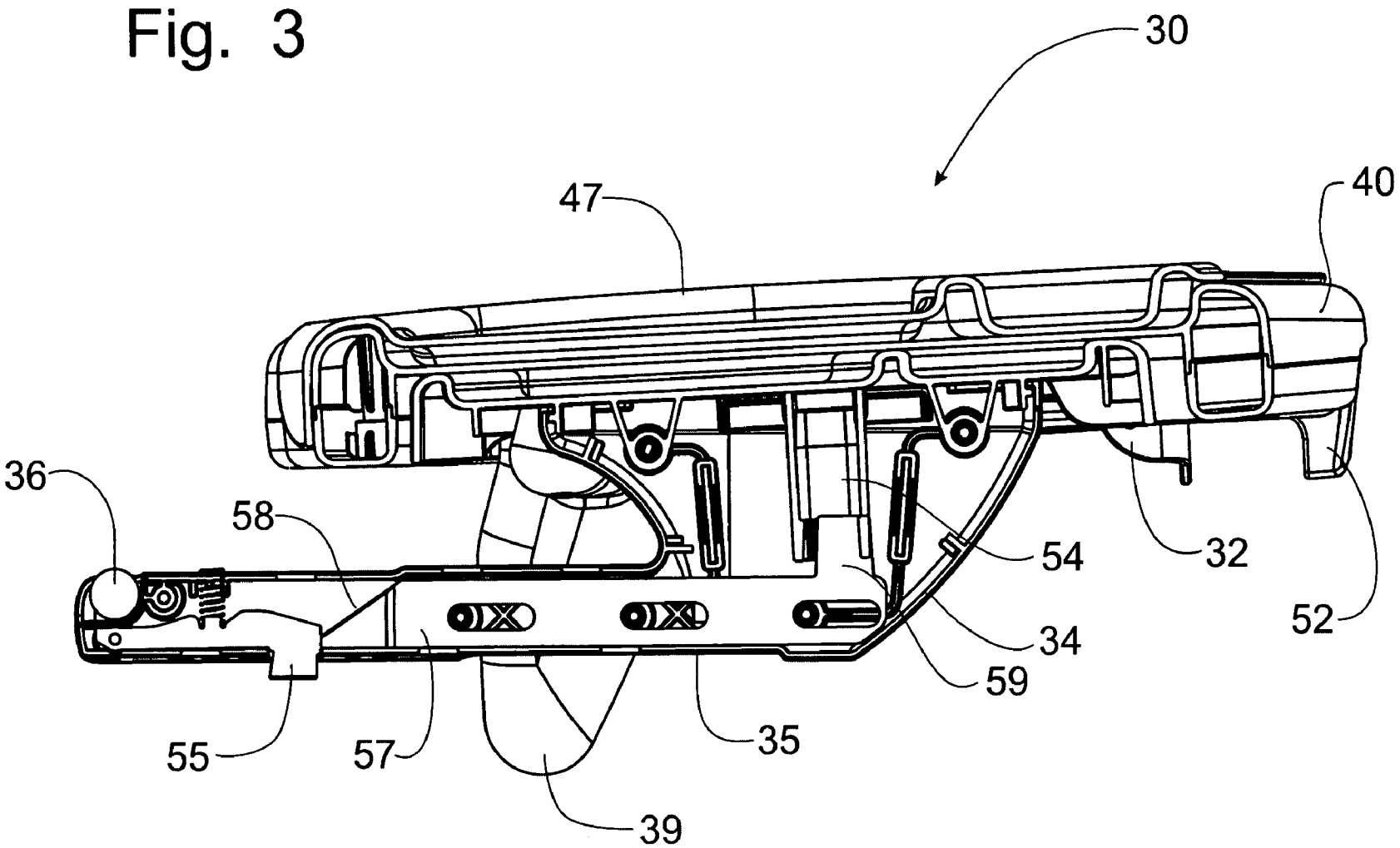
FIG. 3 is a cross-sectional view of the tray system removed from the high chair structure.
Figure 4:
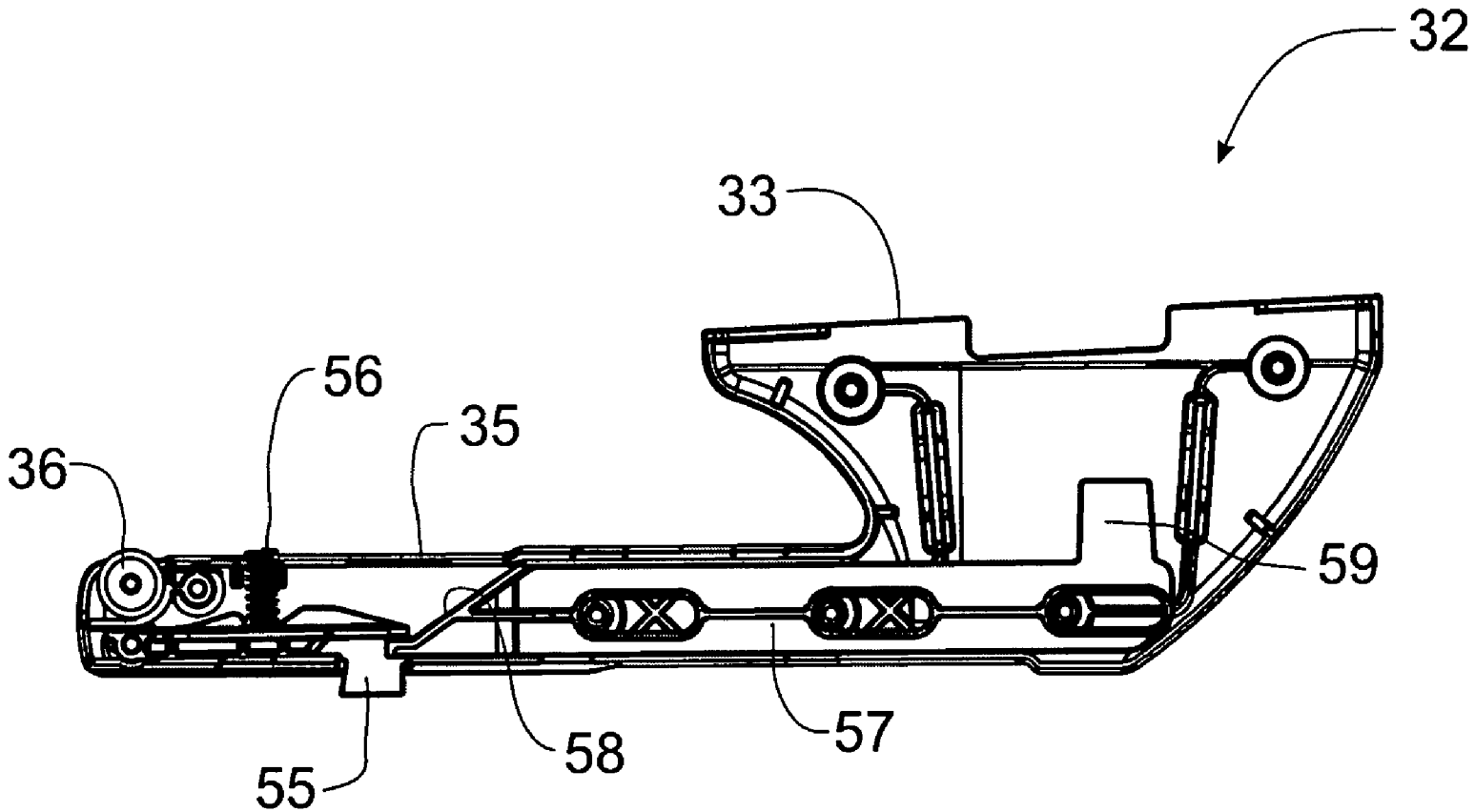
FIG. 4 is a side elevational view of the lower tray with tray post, portions of the lower tray structure being broken away to permit a viewing of the component parts within the tray post.

As can be seen best in FIG. 2, the exterior surface of the arm rests 23 adjacent the sockets 28 is sloped upwardly and rearwardly to define a cam surface that engages the tip of the latch member 55 when the tray posts 35 are first inserted into the sockets 28. The engagement between the cam surface and the tip of the latch member 55 forces the latch member 55 to pivot into the tray post 35 against the biasing spring 56 so that the latch member 55 will not restrict the movement of the tray system 30 into the sockets 28. Accordingly, the latch members 55 will retract into the respective tray post, sliding over the roller 29 until the tip of the latch member 55 becomes aligned with the first opening in the socket 28, whereupon the spring 56 will force the latch member 55 to engage this first opening and stop the rearward movement of the tray posts 35 within the sockets 28.

Further rearward movement of the tray system 30 can then be accomplished by depressing the actuation button 52 to cause the latch member 55 to be retracted until the desired positioning of the tray system 30 is achieved. Preferably, the forward side of the tip of the latch member 55 is squared off so that forward longitudinal forces exerted onto the tray system 30 will not cause a cam action that will pop the tip of the latch member 55 out of engagement with the selected opening in the socket 28. The rearward side of the tip of the latch member 55 is formed with a back angle to prevent an application of rearward longitudinal forces from causing the latch member 55 to pop out of engagement with the selected opening in the socket 28. Thus, once the latch member 55 is aligned with the first opening in the socket 28 as the tray posts are first inserted into the sockets 28, operation of the position adjustment mechanism 50 is necessary to either adjust the fore-and-aft position of the tray system 30 or affect a removal of the tray system 30 from the high chair 10.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A high chair comprising:

a chair member having a seat portion and laterally spaced arm rests formed with a longitudinally extending socket;

a tray system including a first tray member formed with rearwardly extending tray posts alignable with said sockets; and at least one anti-friction device corresponding to each said tray post and including at least one roller being mounted in one of said tray post and the corresponding said socket to minimize friction between each said tray post and the corresponding socket when said tray posts are inserted into said sockets to detachably mount said tray system on said chair member.

2. The high chair of claim 1 wherein said at least one anti-friction member includes a first and second anti-friction member, said first anti-friction member being located at a distal end of said tray post, each said arm rest having said second anti-friction member mounted therein at a forward portion thereof for engagement with said tray post when inserted into the corresponding said socket.

3. The high chair of claim 2 wherein both said first and second anti-friction members comprise first and second rollers, respectively.

4. The high chair of claim 3 wherein said first roller is positioned to engage an upper surface of said corresponding socket and said second roller is positioned to engage a lower surface of said corresponding tray post.

5. A high chair comprising:

a chair member having a seat portion and laterally spaced arm rests;

a tray system including a first tray member detachably mounted on said arm rests and a second tray member detachably mountable on said first tray member such that both said first and second tray members are positionally adjustable in unison on said high chair; a pair of laterally spaced latch members on said second tray member positioned for engagement with the first tray member to secure the second tray member thereto, said latch members being mounted for movement between an engagement position and a release position, said latch members being biased toward said engagement position, each said latch member being formed with a cam surface that is operable to force movement of said latch member against the bias force when placed into engagement with said first tray member, and said second tray member being configured to receive a tray insert.

6. The high chair of claim 5 wherein said second tray member is formed to nest with said first tray member, said latch members being operable to engage side portions of said first tray member.

7. The high chair of claim 5 wherein said first tray member is formed with a retention horn extending downwardly therefrom to be positionally adjustable with said first tray member.

8. The high chair of claim 5 wherein said first tray member includes an actuation mechanism at a front portion thereof to adjust the first tray member relative said high chair, the second tray member being formed with a notch to allow part of the actuation mechanism to project outwardly through said second tray member so as to be accessible when said second tray member is mounted on said first tray member.

9. A high chair comprising:

a chair member having a seat portion and laterally spaced arm rests;

a tray system including a lower tray formed with laterally spaced tray posts operable to be detachably coupled to said arm rests, and a upper tray larger than said lower tray detachably coupled to said lower tray, wherein said lower tray is positionally longitudinally adjustable relative to the chair member so that said upper tray is longitudinally movable with said lower tray when secured thereto so as to be adjustable relative to said chair member only when moved together with said lower tray, said upper tray being separable from said lower tray so that said lower tray can be utilized in lieu of said upper tray; and an actuation mechanism mounted beneath said lower tray for manipulation to adjust the position of the lower tray relative to said chair member, said upper tray being formed with a notch to allow an actuator portion of said actuation mechanism to project outwardly through said upper tray so as to be accessible to longitudinally move said lower tray when said upper tray is mounted on said lower tray.

10. The high chair of claim 9 wherein said upper tray includes a pair of laterally spaced latch members positioned for releasable engagement with said lower tray to secure said upper tray thereto, said latch members being mounted for lateral sliding movement between an engagement position and a release position.

11. A high chair comprising:

a chair member including laterally spaced arm rests formed, respectively, with a longitudinally extending socket;

a tray system including a lower tray formed with rearwardly extending tray posts movably connectable with said sockets such that the tray system is positionally adjustable in a longitudinal direction relative to said chair member; and said lower tray further including a first anti-friction member mounted on a distal end of said tray post to minimize friction between each said tray post and the corresponding said socket when said tray posts are inserted into said sockets to detachably mount said lower tray on said chair member, each said socket including a second anti-friction member therein at a forward portion thereof for engagement with the corresponding said tray post when inserted therein wherein said first and second anti-friction members comprise first and second rollers, respectively.

12. The high chair of claim 11 further comprising:

a position adjustment mechanism interengaging said tray system and said chair member to selectively locate said tray system in one of a plurality of selectable positions relative to said chair member, said position adjustment mechanism including an actuation member positioned at a forward central position on said tray system.

13. The high chair of claim 12 wherein said tray system includes an upper tray detachably mounted on said lower tray to be movable therewith when said upper tray is mounted on said lower tray, said actuation member being supported on said lower tray, said upper tray including a notch formed in a front central portion thereof so that said actuation member projects from said lower tray through said upper tray for access to said actuation member when said upper tray is mounted on said lower tray.

14. The high chair of claim 11 wherein said upper tray further includes:

a pair of laterally spaced latch members positioned for engagement with the lower tray to secure the upper tray thereto, said latch members being mounted for lateral sliding movement between an engagement position and a release position, said latch members being biased toward said engagement position.

15. The high chair of claim 14 wherein said upper tray is formed to nest with said lower tray, said latch members being operable to engage side portions of said lower tray.

16. The high chair of claim 11 wherein said lower tray includes a retention horn member extending downwardly therefrom to be positionally adjustable with said lower tray relative to said chair member.

17. The high chair of claim 11 wherein said first roller is positioned to engage an upper surface of said corresponding socket and said second roller is positioned to engage a lower surface of said corresponding tray post.

* * * * *